US006107901A

United States Patent [19]

Crouch et al.

[11] Patent Number: 6,107,901

[45] Date of Patent: Aug. 22, 2000

[54] REDUCED-SIZE WAVEGUIDE DEVICE

[75] Inventors: David D. Crouch, Corona; Kenneth W. Brown, Yucaipa, both of Calif.

[73] Assignee: Raytheon Company, Lexington, Mass.

[21] Appl. No.: 09/098,130

[22] Filed: Jun. 16, 1998

[51] Int. Cl.[7] ..... H01P 3/12

[52] U.S. Cl. ..... 333/239; 333/248

[58] Field of Search ..... 333/239, 248

[56] References Cited

U.S. PATENT DOCUMENTS

| | | | |
|---|---|---|---|
| 2,433,368 | 12/1947 | Johnson et al. | 333/239 X |
| 2,577,619 | 12/1951 | Kock | 333/248 X |
| 2,761,137 | 8/1956 | Van Atta et al. | 333/239 X |
| 2,840,788 | 6/1958 | Mullett et al. | 333/248 X |
| 3,016,502 | 1/1962 | Unger | 333/239 X |
| 4,463,329 | 7/1984 | Suzuki | 333/239 |
| 4,825,221 | 4/1989 | Suzuki et al. | 333/239 X |
| 5,528,208 | 6/1996 | Kobayashi | 333/248 X |

FOREIGN PATENT DOCUMENTS

| | | | |
|---|---|---|---|
| 1532983 | 12/1989 | U.S.S.R. | 333/239 |

*Primary Examiner*—Paul Gensler
*Attorney, Agent, or Firm*—David W. Collins; Andrew J. Rudd; Glenn H. Lenzen, Jr.

[57] ABSTRACT

An apparatus for propagating electromagnetic waves at a predetermined reduced guide wavelength. A waveguide (27*b*) is provided for receiving and guiding the electromagnetic waves. A dielectric (28) is disposed in the waveguide (27*b*) to decrease the guide wavelength of the received electromagnetic waves. The dielectric (28) allows the width of the waveguide (27*b*) to be reduced without significantly compromising its power-carrying capability.

14 Claims, 3 Drawing Sheets

$TE_{10}$ $TE_{01}$

REDUCED-SIZE WAVEGUIDE DEVICE

BACKGROUND OF THE INVENTION

1. Field of the Invention

The present invention relates generally to waveguide devices, and more particularly, to size and guide wavelength modification for waveguide devices.

2. Description of Related Art

A significant disadvantage of conventional waveguides is their size and large guide wavelength. For example, WR-975 waveguides (which can be obtained from such companies as Mega Industries and are designed for use between the frequencies of 0.75 and 1.12 GHz) has a width of 9.75 inches and a height of 4.875 inches. The height of a conventional waveguide can be reduced without affecting the fundamental-mode cutoff frequency and guide wavelength, but the same is not true of its width.

Moreover, reductions in cross-sectional area in ridged waveguides require that the gap between the ridges be on the order of one-quarter the height of the waveguide. This substantially reduces the power-carrying capacity of the waveguide, leaving it susceptible to breakdown at high power levels. In addition, the guide wavelength in ridged waveguides is approximately equal to that in other conventional waveguides, so that nearly equal lengths of either ridged or conventional waveguides are required to achieve a given phase shift.

SUMMARY OF THE INVENTION

In accordance with the teachings of the present invention, an apparatus is provided for propagating electromagnetic waves at a predetermined reduced guide wavelength. A waveguide is provided for receiving and guiding the electromagnetic waves. A dielectric is disposed in the waveguide to decrease the guide wavelength of the received electromagnetic waves.

DESCRIPTION OF THE PREFERRED EMBODIMENTS

Figure 1:
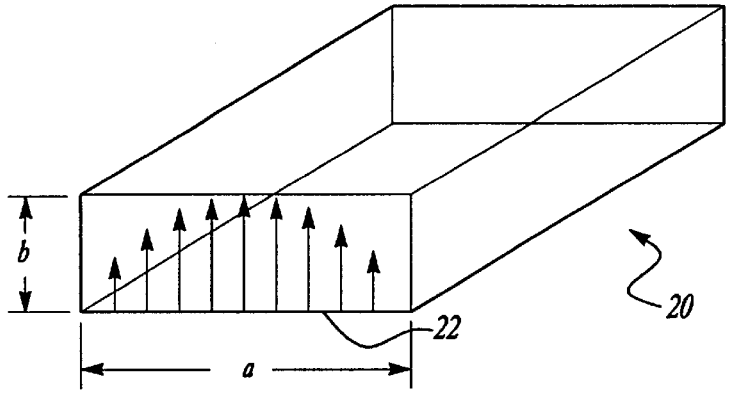
Fig-1 Prior Art
FIG. 1 is a perspective view of a conventional waveguide with electric field lines depicted.

FIG. 1 illustrates a cross section of a conventional rectangular waveguide 20. The desired mode of propagation in such a waveguide is usually the $TE_{10}$ mode, whose electric field lines 22 are as shown in FIG. 1. The cutoff frequency $f_c$ for this mode is $$f_c = \frac{c}{2a\sqrt{\varepsilon_R}}, \tag{1}$$

where $\epsilon_R$ is the relative permittivity of the dielectric filling the waveguide 20 and the term c is velocity of light constant. If the width a of waveguide 20 is chosen to maintain the cutoff frequency at some desired value, then a must decrease as $\epsilon_R$ increases. For example, WR-975 waveguide, which is designed for use with RF frequencies between 0.75 and 1.12 GHz, has a=9.75" and b=4.875". Its cutoff frequency is 0.605 GHz. If the guide is filled with a dielectric having $\epsilon_R$=4, a can be reduced by a factor of two (to 4.875") without changing the cutoff frequency of the $TE_{10}$ mode.

Figure 2A:
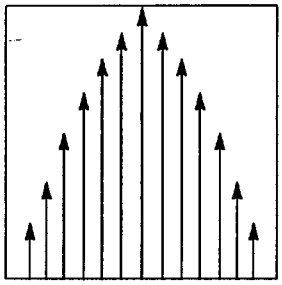
Fig-2a Prior Art
FIGS. 2*a* and 2*b* are electric field line diagrams showing degenerate $TE_{10}$ and $TE_{01}$ modes respectively for a conventional square waveguide.
Figure 2B:
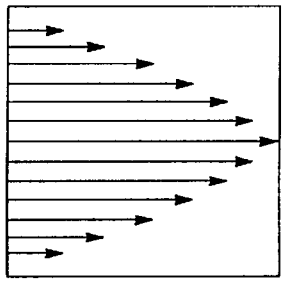
Fig-2b Prior Art

While the guide could be filled with a conventional isotropic dielectric and achieve the same size reduction, this approach can be costly (depending on the material) and adds significantly to the weight of the waveguide. Also, for the example considered above, it results in a square waveguide in which the $TE_{10}$ (FIG. 2*a*) and $TE_{01}$ (FIG. 2*b*) modes are degenerate, i.e., they have the same cutoff frequency, which is undesirable in many applications.

Figure 3A:
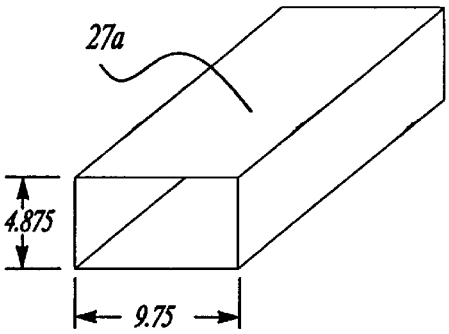
Fig-3a Prior Art
FIGS. 3*a* and 3*b* are perspective views showing respectively a conventional full-height WR-975 waveguide and a full-height reduced-size waveguide that utilizes the techniques of the present invention.

FIG. 3*a* depicts a conventional full-height WR-975 waveguide 27*a*. Conventional waveguide 27*a* has a cutoff frequency of 605 MHZ and a height and width respectively of: 4.875 inches and 9.75 inches.

Figure 3B:
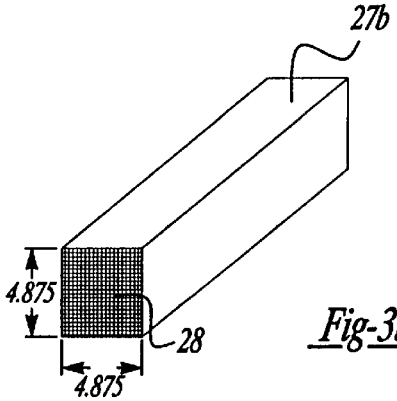

FIG. 3*b* depicts a novel full-height reduced-size waveguide 27*b* that has been filled with dielectric 28. The dielectric-filled waveguide 27*b* has the same cutoff frequency as conventional waveguide 27*a* but has only half the width (i.e., 4.875 inches) Accordingly, the novel dielectric-filled waveguide 27*b* has the decided advantage of consuming less space than conventional waveguide 27*a*.

Figure 4A:
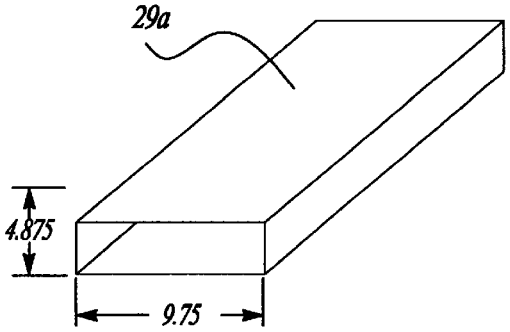
Fig-4a Prior Art
FIGS. 4*a* and 4*b* are perspective views showing respectively a conventional half-height WR-975 waveguide and a half-height reduced-size waveguide that utilizes the techniques of the present invention.

As another example, FIG. 4*a* depicts a conventional half-height WR-975 waveguide 29*a* with a cutoff frequency of 605 MHZ and a height and width respectively of: 2.4375 inches and 9.75 inches.

Figure 4B:
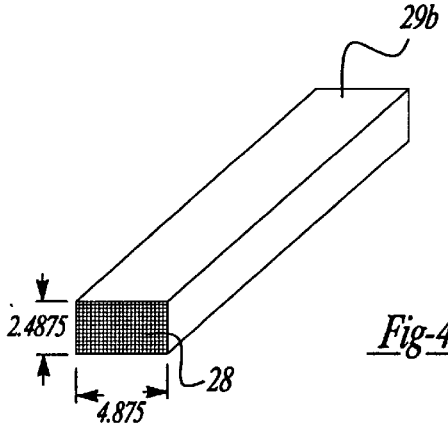

FIG. 4*b* depicts a novel half-height reduced-size waveguide 29*b* that has been filled with dielectric 28. The dielectric-filled waveguide 29*b* has the same cutoff frequency as conventional waveguide 29*a* but has only half the width (i.e., 4.875 inches).

The present invention preferably includes dielectric 28 being an anisotropic artificial dielectric with metallic scatterers embedded in a lightweight substrate, in order to reduce the width of the waveguide while not affecting the cutoff frequency of the waveguide. By using a lightweight anisotropic artificial dielectric, e.g., one having $\epsilon_R$=4 for a vertically-polarized electric field and $\epsilon_R$=1 for a horizontally-polarized electric field, a factor of two reduction in size is obtained with little or no weight penalty and the cutoff frequency of the $TE_{01}$ mode is unaffected by the presence of the artificial dielectric.

Figure 5A:
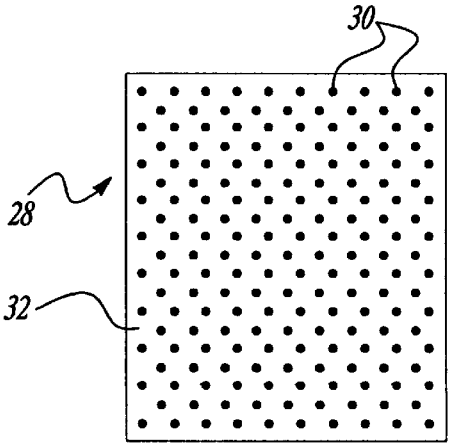
FIGS. 5*a* and 5*b* are top and side views respectively of an artificial dielectric.
Figure 5B:
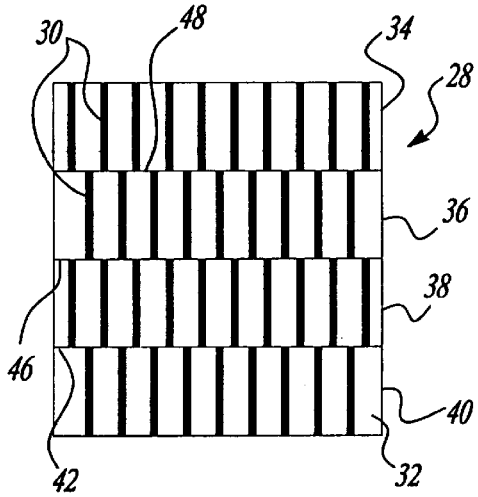

FIGS. 5*a* and 5*b* depict an embodiment of an artificial dielectric 28 which is embedded with small metallic scatterers 30 in a lightweight substrate 32 (e.g., a foam, such as Styrofoam). If the individual scatterers 30 are small relative to the wavelength of interest, then the permittivity of the artificial dielectric 28 is given by:

$$\epsilon_R = 1 + n\alpha, \tag{2}$$

where n is the number of scatterers per unit volume, and $\alpha$ is the polarizability of an individual scatterer.

While there are many scatterer shapes that can be selected, a long, thin wire with its major axis parallel to the electric field is particularly effective. The polarizability of an individual wire can be calculated numerically by using the method of moments to calculate the free-space scattered far field due to an incident plane wave having its electric field polarized parallel to the axis of the wire. The scattered far field $E_\theta$ of a wire having dipole moment p is given by:

$$E_\theta = -\frac{\pi p \sin\theta}{\lambda^2 \varepsilon_0 R} e^{i(\omega t - kr)} \tag{3}$$

The dipole moment p is determined by equating the calculated amplitude of the scattered far field at broadside (θ=90°) to the amplitude in the above expression (3):

$$p_{wire} = \frac{\lambda^2 \varepsilon_0 R}{\pi} E_{far}. \tag{4}$$

The polarizability is proportional to the ratio of the dipole moment to the incident electric field. For a wire scatterer (30) one-half cm in length and 0.6 mm in diameter, the polarizability is found to be:

$$\alpha_{wire} = \frac{p_{wire}}{\varepsilon_0 E_{inc}} = 6.1 \times 10^{-8} m^3, \tag{5}$$

where $E_{inc}$ is the electric-field amplitude of the plane wave incident on the wire (1 V/m in this case and the term $P_{wire}$ represents the dipole moment of the wire).

If it is desired to reduce the width of a given waveguide by a factor of two, then it is filled with a material having $\epsilon_R$=4. The artificial dielectric should satisfy:

$$n\alpha_{wire}3,= \tag{6}$$

where n is the density of scatterers in the artificial dielectric. Given the value of $\alpha_{wire}$ determined above, the required density is given by the following equation:

$$n = \frac{3}{\alpha_{wire}} = 49.2 \text{ cm}^{-3} \tag{7}$$

With reference to FIG. 5*b*, an artificial dielectric 28 was constructed in four layers (layers 34, 36, 38, and 40), each 0.5 cm thick and containing a rectangular grid of vertical wire scatterers 30 with 0.2 cm between nearest neighbors in the plane of each layer. To prevent wires in adjoining layers from touching, the grid patterns were offset in alternating layers, and thin sheets of Mylar (42, 46 and 48) were placed between neighboring layers to provide extra insulation against breakdown.

Figure 6:
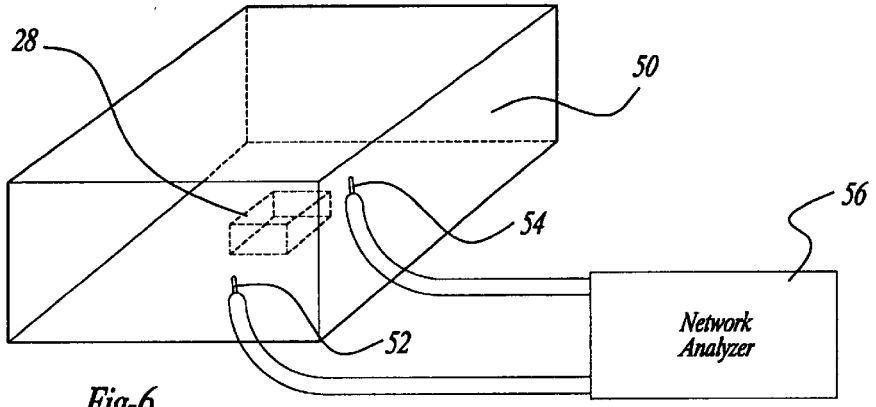
FIG. 6 is a perspective view of the measurement set-up for measuring dielectric constants and loss tangents.

With reference to FIG. 6, measurements of the electromagnetic properties of the dielectric 28 were made using a perturbation technique, in which the dielectric 28 was placed inside a cavity 50 and its properties determined by its perturbing effect on the cavity's resonant frequency and bandwidth. The dielectric 28 was placed inside a metallic cavity 50, constructed from a piece of WR-975 waveguide. The length of cavity 50 was adjusted so that the $TE_{101}$ cavity mode would resonate near 915 MHZ, the frequency at which the properties of the dielectric 28 were desired.

The resonant frequency and bandwidth of the cavity 50 were measured by means of two coaxial probes 52 and 54 connected to a network analyzer 56 which was capable of measuring the insertion loss through cavity 50. At resonance, the insertion loss between the probes (52 and 54) is decreased to a small but measurable value, over a small bandwidth (the coaxial probes 52 and 54 were constructed so that they had little coupling into cavity 50 in order to maintain a relatively high loaded cavity Q). The cavity resonant frequency and bandwidth could then be measured with or without a dielectric inserted inside the waveguide cavity.

With the setup in FIG. 6, the relative dielectric constant of the sample was shown to be approximately:

$$\varepsilon_r \cong 1 + 2\left(\frac{F_{rl} - F_{r2}}{F_{rl}}\right) \frac{\iiint_V |E_1|^2 dV}{\iiint_{\Delta V} |E_1|^2 dV}, \tag{8}$$

where:

$\epsilon_r$=Relative dielectric constant of the sample, $F_{r1}$=Cavity resonant frequency with no sample, $F_{r2}$=Cavity resonant frequency with sample, $E_1$=Electric field inside cavity with no sample, V=Volume of cavity, and ΔV=Volume of sample.

The electric field ($E_1$) is known from waveguide theory to be the $TE_{101}$ mode of cavity 50. Similarly, the loss tangent can be shown to be approximately:

$$\delta \cong \frac{(B_2 / F_{r2} - B_1 / F_{R1})}{\varepsilon_R} \frac{\iiint_V |E_1|^2 dV}{\iiint_{\Delta V} |E_1|^2 dV}, \tag{9}$$

where

δ=Loss tangent of the sample, $B_1$=Cavity bandwidth with no sample, and $B_2$=Cavity bandwidth with sample.

Three measurements of the cavity insertion loss were performed (using the network analyzer 56): the empty cavity 50, the cavity 50 with the dielectric 28, and cavity 50 with a known sample of dielectric TEFLON (i.e., polytetrafluoroethylene) having the same size as dielectric 28.

Figure 7:
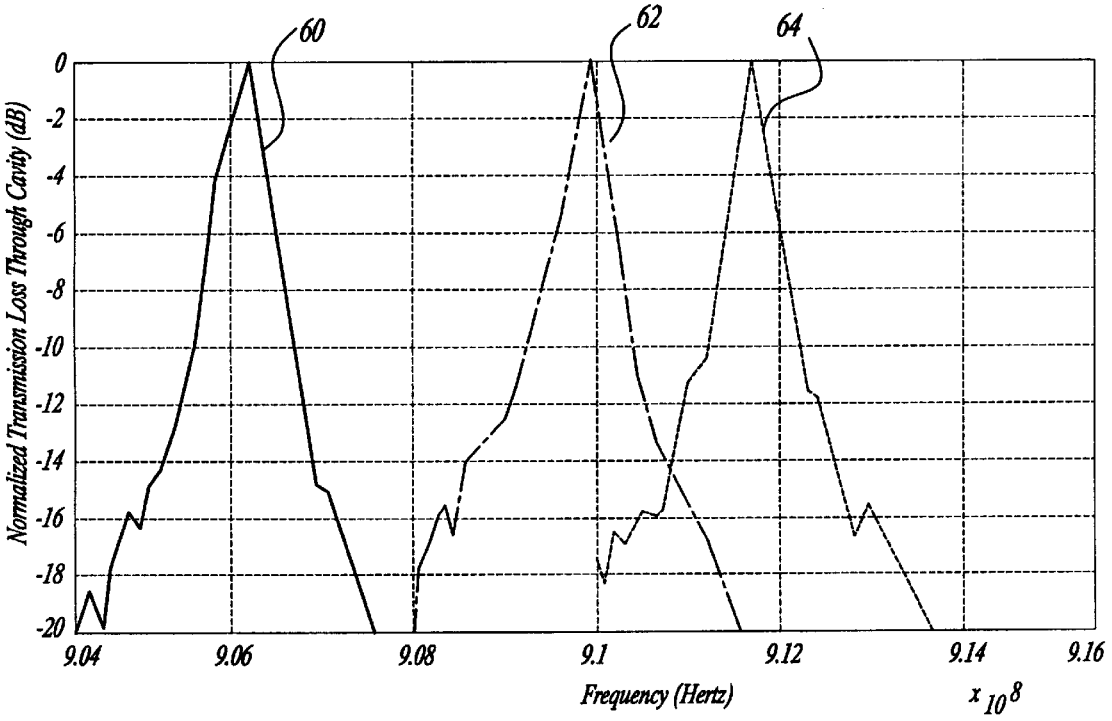
FIG. 7 is an x–y graph depicting normalized transmission loss through a cavity vs. frequency.

Plots of the insertion loss versus frequency for these three cases are shown in FIG. 7: plot 64 which plots the relationship for when cavity 50 was empty; plot 60 which plots the relationship for when cavity 50 contained artificial dielectric 28; and plot 62 for when cavity 50 contained a sample of TEFLON. From the insertion loss data of FIG. 7, the resonant frequency and bandwidth of the insertion loss could be found. This information is summarized in Table 1.

TABLE 1

| Sample | Resonant Frequency | Transmission Bandwidth |
|---|---|---|
| None | 911.78 MHZ | 372.30 kHz |
| Artificial Dielectric | 906.22 MHZ | 399.96 kHz |
| TEFLON | 909.88 MHZ | 392.65 kHz |

From the information in Table 1, and using Equations (8) and (9), the dielectric constant and loss tangent of the samples were computed. These values are shown in Table 2.

TABLE 2

| Sample | Dielectric Constant | Loss Tangent |
|---|---|---|
| None | N/A | N/A |
| Artificial Dielectric | 4.18 | 0.0020 |
| TEFLON | 2.09 | 0.0029 |

From Table 2, it can be seen that the dielectric constant for the TEFLON sample was measured to be 2.09. Typically in the literature, TEFLON is reported to have a dielectric constant of about 2.1, which makes this measurement very close. The loss tangent of the TEFLON was measured at 0.0029.

When dielectric 28 is used in a waveguide carrying significant amounts of RF (radio frequency) power, it is designed to have a reasonable voltage-standoff capability. A dc high voltage was placed across dielectric 28 described above. Voltage breakdown did not occur for any voltage applied to dielectric 28. Styrofoam pads (not shown) were used to separate the top and bottom surfaces of dielectric 28 from the electrodes, which resulted in a separation of 1.1 inches (2.794 cm) between electrodes. At the maximum applied voltage of 30 kV, the electric field strength corresponding to this separation was 10.7 kV/cm. The significance of this is seen by calculating the power-handling capability of an artificial-dielectric filled reduced-size waveguide through which is propagating a $TE_{10}$ mode having a peak electric-field amplitude of 10.7 kV/cm. The propagating power is:

$$P = \frac{\sqrt{\varepsilon_R}}{4\eta_0}\sqrt{1-\left(\frac{f_c}{f}\right)^2}\,abE_{10}^2, \tag{10}$$

where $\eta_0$=377 Ω and is the impedance of free space and the term $f_c$ is the cutoff frequency, and the term a is the width and the term b is the length. The propagating power is proportional to the product of the area and $\sqrt{\epsilon_R}$. When this product is held constant as the waveguide dimensions are reduced, the power-carrying capacity remains constant. Consider a reduced-size version of WR-975 waveguide in which the width was reduced by a factor of two, resulting in a square waveguide having "a=b=4.875" (12.3825 cm) and a resulting cross-sectional area of 23.77 $in^2$. With $f_c$=605 MHZ and f=915 MHZ, the maximum power $P_{max}$ that can be propagated through this waveguide without breakdown satisfies the following equation:

$$P_{\mathrm{MAX}} > \frac{\sqrt{\varepsilon_R}}{4\eta_0}\sqrt{1-\left(\frac{f_c}{f}\right)^2}\,abE_{\mathrm{MAX}}^2 = 17.5\ \mathrm{MW}, \tag{11}$$

where $E_{max}$=10.7 kV/cm. The 17.5 MW is a lower limit and not an absolute limit. The present invention includes an artificial dielectric that safely stands off 15 kV/cm. For such a material, the power-handling capacity of the waveguide described above increases to 34.3 MW, which is substantially similar to the rated power-handling capacity of a conventional WR-975 waveguide at this frequency.

It will be appreciated by those skilled in the art that various changes and modifications may be made to the embodiments discussed in the specification without departing from the spirit and scope of the invention as defined by the appended claims. For example, while an artificial dielectric has been discussed, the present invention also includes using a dielectric consisting of naturally occurring materials, such as Corning 7070 glass, for which ε=4.0 and tan δ=1.2×$10^{-3}$ at 3 GHz.

What is claimed is:

1. An apparatus for propagating electromagnetic waves at a predetermined decreased guide wavelength, said apparatus having a cutoff frequency associated with the electromagnetic waves, comprising:

a waveguide for receiving and guiding the electromagnetic waves;

an artificial anisotropic dielectric being disposed substantially throughout said waveguide to decrease the guide wavelength of said received electromagnetic waves, said apparatus providing a reduction in size of said waveguide without substantially changing the cutoff frequency.

2. The apparatus of claim 1 wherein said waveguide has an associated cutoff frequency with respect to the electromagnetic wave, and wherein said guide wavelength is decreased by said dielectric while the cutoff frequency of said waveguide remains substantially the same.

3. The apparatus of claim 2 wherein said dielectric includes a lightweight material.

4. The apparatus of claim 1 wherein said dielectric includes a lightweight material.

5. The apparatus of claim 1 wherein said dielectric includes scattering devices for scattering said electromagnetic waves.

6. The apparatus of claim 5 wherein said scattering devices include wire scatterers.

7. The apparatus of claim 1 wherein said waveguide having a reduced width due to said dielectric being present in said waveguide.

8. An apparatus for propagating electromagnetic waves at a predetermined decreased guide wavelength, said apparatus having a cutoff frequency associated with the electromagnetic waves, comprising:

a rectangular waveguide for receiving and guiding the electromagnetic waves and having a cross-section;

an artificial anisotropic dielectric being disposed substantially throughout the cross-section of said waveguide and having a relative permittivity that allows the guide wavelength of said received electromagnetic waves to be decreased without substantially changing the cutoff frequency.

9. The apparatus of claim 8 wherein said waveguide has an associated cutoff frequency with respect to the electromagnetic wave, and wherein said guide wavelength is decreased by said dielectric while the cutoff frequency of said waveguide remains substantially the same.

10. The apparatus of claim 9 wherein said dielectric includes a lightweight material.

11. The apparatus of claim 8 wherein said dielectric includes a lightweight material.

12. The apparatus of claim 8 wherein said dielectric includes scattering devices for scattering said electromagnetic waves.

13. The apparatus of claim 12 wherein said scattering devices include wire scatterers.

14. The apparatus of claim 8 wherein said waveguide having a reduced width due to said dielectric being present in said waveguide.

* * * * *